United States Patent [19]

Loucks

[11] 4,153,871

[45] May 8, 1979

[54] IMPLICIT PULSE-TO-PULSE HIGH VOLTAGE DETECTION AND CONTROLLER

[75] Inventor: Richard S. Loucks, Northridge, Calif.

[73] Assignee: International Telephone and Telegraph Corporation, New York, N.Y.

[21] Appl. No.: 830,082

[22] Filed: Sep. 2, 1977

[51] Int. Cl.[2] ..... G05F 5/00

[52] U.S. Cl. ..... 323/19; 323/8; 323/93; 328/67; 328/176

[58] Field of Search ..... 323/8, 19, 81, 93; 328/53–55, 58, 66, 67, 78, 176

[56] References Cited

U.S. PATENT DOCUMENTS

| | | | |
|---|---|---|---|
| 3,025,411 | 3/1962 | Rumble | 328/67 X |
| 3,374,443 | 3/1968 | Braum et al. | 328/66 X |
| 3,660,672 | 5/1972 | Berger et al. | 323/8 X |
| 3,749,976 | 7/1973 | Colyn | 323/8 X |
| 3,915,672 | 10/1975 | Penney | 328/67 X |

OTHER PUBLICATIONS

Church, "General-Purpose of Amp Forms Active Divider," Electronics, May 24, 1973, p. 122.

*Primary Examiner*—A. D. Pellinen
*Attorney, Agent, or Firm*—William T. O'Neil

[57] ABSTRACT

A device for precise vernier control of the net charge on the high-voltage filter capacitor in a high voltage, high energy power supply through control of the charge on a low-voltage capacitor in series with the grounded end of the main high-voltage filter/storage capacitor of a power supply. Current in this series capacitor arrangement is detected bidirectionally by a current transformer, the output of which is time-integrated. An error signal is detected by a reference amplifier through comparison of the instantaneous low-voltage (bootstrap) capacitor with the integrated value, the latter being a precise analog of the high voltage across the filter capacitor. The bootstrap signal in current amplified form is fed back (in the proper sense) from the output of this comparison to the low-voltage capacitor. Since the net high voltage is the algebraic sum of the voltages on the main filter capacitor and this bootstrap capacitor, the high voltage is thereby controlled or regulated on a pulse-to-pulse basis.

9 Claims, 1 Drawing Figure

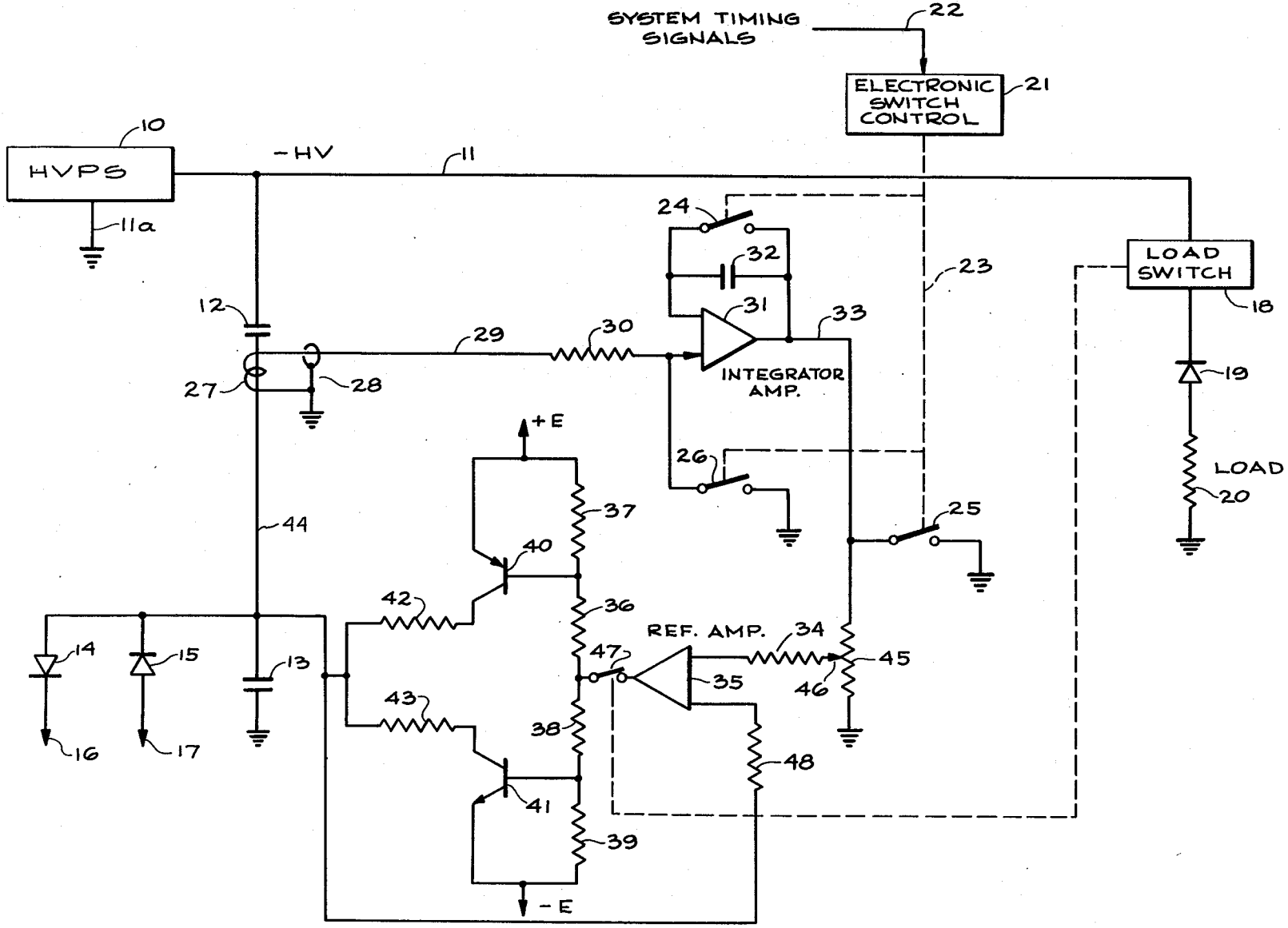
SYSTEM TIMING SIGNALS
22
ELECTRONIC SWITCH CONTROL
21
LOAD SWITCH
18
19
LOAD
20
23
25
45
46
34
48
33
INTEGRATOR AMP.
32
31
24
26
REF. AMP.
35
30
37
36
47
39
+E
40
38
41
-E
29
42
43
11
28
-HV
44
13
12
27
15
17
14
16
10
HVPS
11a

IMPLICIT PULSE-TO-PULSE HIGH VOLTAGE DETECTION AND CONTROLLER

BACKGROUND OF THE INVENTION

1. Field of the Invention

The invention relates to voltage regulation devices in general and more specifically to voltage regulation in power supplies feeding pulsed loads.

2. Description of the Prior Art

In the prior art, the engineering problem of controlling, stabilizing or regulating a high-voltage source has been variously addressed. In pulsed-load applications (for example, in radar systems), a source of high-voltage direct current is usually required, and a pulse modulator or electronic switching device develops a high-voltage, high-energy pulse therefrom which is used to energize a magnetron, amplitron, traveling wave tube or similar microwave oscillator or amplifying device.

The type of pulsed load aforementioned can require very high peak power, although in view of the relatively low duty cycle of devices such as pulsed radar transmitters, the average power is a relatively small fraction of the peak power. Accordingly, power supply components which would be capable of supplying the peak powers over an appreciable period of time are not used, since the disadvantages from a point of view of energy efficiency, cost and weight require the use of power supplies capable of supplying little more than the average power, these having relatively high internal impedance and relying on filter/storage capacitor arrangements to supply the peak power.

In some radar applications as, for example, when so-called moving target indicator circuits (MTI) are being used, the phase coherence of the transmitted signal must be preserved. Since the hereinbefore referred to RF generators and amplifiers are sensitive to the modulating pulse amplitude in respect to RF phase coherence, it is important that the initial or starting point during each transmitted pulse be repeatable. If it is, at least some "droop" can be tolerated thereafter, since this tends to be consistent and repeatable if the starting, instantaneously applied pulse voltage is repeatable from one pulse to the next.

In radar systems of the type, direct bootstrap regulators have been applied and are known per se in this field. Such direct bootstrap regulators are subject to transients because of arcs or flashovers, which may produce discharge currents of 1000 amperes or more and energy levels in the thousands of joules in systems of considerable radio frequency power-generating capability. Such transients are extremely difficult to isolate from the direct bootstrap device. In the past, the designer has been obliged to use vacuum tubes of large peak current-carrying capability and/or complex filters, bypasses and protective circuitry.

In such conventional or prior art bootstrap circuits, the filter/storage capacitor is fed by a first-order-regulated power supply, the ground end of the filter/storage capacitor thereof being connected through an active element such as a series of vacuum tubes. An error-sensing circuit then grid-drives the vacuum tubes which provide their function by varying the effective resistance in the capacitor current path.

Ordinarily, the first order or coarse-regulating circuits employed may be of a prior art type, such as a pulse-width-controlled inverter type, or the like. The coarse-regulator circuit per se is not able to provide voltage control closer than about ±30 volts when the high voltage itself is on the order of 50,000 volts, although closer, long term regulation is not technically impossible, albeit impractical.

The manner in which the present invention improves upon the state of the art in bootstrap regulators will be evident as this description proceeds.

SUMMARY

It may be said to have been the general objective of the present invention to provide an economical and accurate high-voltage, bootstrap-type regulator for use in connection with pulsed loads such as encountered in the radar transmitter art.

Basically, the device of the invention is a precise vernier control circuit for regulating the charge on a low-voltage capacitor in series with the grounded end of the main high-voltage filter/storage capacitor. These two capacitors form a series unit, the center tap of which is controlled from a current amplifier in accordance with a voltage error-signal developed by integrating, in bipolar fashion, the current variations through the series capacitors.

Sensing of these current excursions is accomplished through the use of a current transformer. The use of a capacitor as a "correctable" element in a bootstrap arrangement affords the opportunity of using solid state, relatively low-voltage components to control the high-voltage output. Arcs and transients are inherently filtered by this low-voltage capacitor, affording protection for the low-voltage control circuitry. The components required are relatively inexpensive and efficiency is high, since the actual vernier voltage adjustment is effected at a low-voltage level. The low-voltage capacitor in the series capacitance unit can be many times larger in capacitance value, vis-a-vis the high-voltage filter/storage capacitor; and accordingly, the voltage "droop" effect at the high-voltage output under load is minimized.

The details of a typical embodiment according to the invention will be described hereinafter.

BRIEF DESCRIPTION OF THE DRAWING

A single FIGURE is presented depicting a typical circuit diagram according to the invention.

DESCRIPTION OF THE PREFERRED EMBODIMENT

Referring now to the FIGURE, the block 10 may be a conventional, well-known form of high-voltage power supply, such as a so-called gate-width-control inverter. Accordingly, the output identified as -HV is coarsely regulated but not sufficiently so as to provide the required transmitted pulse characteristic repeatability hereinbefore mentioned. In this instance, the high negative voltage on line 11 is consistent with radar transmitter requirements, the positive terminal of the power supply 10 being grounded at 11*a*. The load switch 18, sometimes called a pulse modulator in the radar arts, feeds a magnitron, amplitron, or other pulsed RF (microwave) generator or amplifier represented by the combination of resistive load 10 and, in view of the fact that such devices are basically thermionic apparatus, by an equivalent diode 19 in addition.

Since the power supply 10 inherently has appreciable internal impedance, it will be realized that the filter capacitor 12 does not hold its charge and terminal voltage invariant during the pulsing time of switch 18, even though in such systems, the on-time for switch 18 is small compared to the interpulse period. In a particular system employing the present invention, the load switch 18 had an on-time of 65 microseconds and an interpulse period of 2,135 microseconds. The peak pulse power was on the order of 194 kilowatts, the high voltage being on the order of 43,000 volts. The corresponding peak current in the line 11 during closure of 18 is accordingly on the order of 4.5 amperes.

It will be readily understood that a certain amount of "droop" of the high voltage on the line 11 is to be expected; however, it is of course desirable that this "droop" be held to a practical engineering minimum. What is much more significant than the actual "droop" is its repeatability and the repeatability of the initial pulse voltage. That repeatability is especially important where certain types of moving target indicator systems are employed. In those MTI systems, it is important that the phase coherence of the transmitted pulse be preserved. This translates into a requirement for predictable radio frequency phase values throughout the transmitted pulse, and since these phase values are a function of the applied pulse voltage, the apparatus of the present invention is particularly useful, since it is very well adapted to the problem of stabilizing the initial high voltage value and insuring its repeatability pulse-to-pulse.

As indicated previously, the coarse-regulating circuits within 10 are relied upon for long-term stabilization of the high voltage on 11 within some small fraction of a percent (such as ±30 volts or thereabouts in the example given). It is then for the apparatus according to the present invention to operate as a short-term pulse-to-pulse vernier circuit.

After each transmitted pulse, there is a recovery of the high voltage on terminal 11, during which time the switches 24, 25 and 26 may be closed by 21 in accordance with an appropriately timed system-timing signal on lead 22 if MTI requirements are not extant. The recovery of the filter/storage capacitor 12 for a predetermined period of time after the opening of load switch 18 is effected entirely by power supply 10 during which time switch 47 is held open. Thereafter, within a second predetermined time prior to the next closure of load switch 18, an electronic switch control circuit inherent in 18 effects delayed closing of switch 47, this being understood to be electronic in nature, notwithstanding the fact that they are shown as mechanical switches symbolically. The implementation of electronic switching, per se, is extremely well understood in this art, and it is regarded as unnecessary to describe an actual electronic switch circuit performing the described function.

At this point, it should be stated that the series capacitive unit is comprised of 12 and 13, in which the capacitor 12 is a unit of predetermined capacitance (around 1.0 microfarads in the system having the aforementioned parameters). Capacitor 12 is voltage-rated essentially for the full value of high voltage on terminal 11; however, capacitor 13, the bootstrap vernier capacitor, need only be rated (voltagewise) in accordance with the bootstrap voltage excursions on 44. These are, as previously indicated, a small fraction of the high voltage on 11, the actual voltage values being comparable to the errors on lead 11 which are to be corrected by the bootstrap circuit.

In order to further exploit the advantageous aspects of the use of a capacitor such as 13 as the bootstrap element, capacitor 13 is made large in capacitance compared to 12 (for example, ten times the value of the capacitance value of 12, i.e. 10.0 microfarads in the example). This not only acts to reduce the "droop" experienced during closure of load switch 18, but capacitor 13 is thereby readily able to bypass the much larger transients caused by arcing in the load, thereby avoiding the need for any extraordinary current bypass measures at lead 44. It will be noted that arc currents would exist as current transients about the loop comprising capacitors 13 and 12, lead 11, load switch 18, load elements 19 and 20, and back through the ground return of capacitor 13.

The clamp diodes 14 and 15 are positively and negatively back-biased at leads 16 and 17, respectively, as assurance against spurious build-up of voltage across the capacitor 13 due to circuit malfunctions. Actually, the terminal 16 might be brought back to the +E connection at the emitter of transistor 40, and terminal 17 could be likewise to the −E connection at the emitter of transistor 41. These voltages + and −E might be in a ten-to-twenty volt range for certain applications or, if high-voltage type transistors are used at 40 and 41, these voltages might be as much as ±250 volts. Referring now to the current transformer 27, a voltage signal is developed representative of the instantaneous current flowing in the series capacitor unit 12 and 13. A shield on the ungrounded terminal of 27 extending over lead 29 is shown at 28, however, depending upon actual voltages, and circuit hardware layout, such as a shield, may or may not be necessary.

It will be seen that on lead 29 a voltage signal is presented which faithfully represents the current excursions, both up and down, in these capacitors. The resistor 30, amplifier 31 and capacitor 32 comprise an integrator circuit in familiar form, per se. From the output 33 thereof, a voltage signal is available which is a precise analog of high voltage across the filter capacitor 12, save for matters of scale factor. Variable tap resistor 45 provides for scale factor adjustment whereby the voltage signal at its tap 46 may be adjusted to provide overall empirical adjustment of the circuit. Observation of the waveform at 44 or, for that matter, the high voltage waveform at 11 through suitable high voltage oscilloscope test methods, can provide the basis for adjustment of the slider 46, thereby compensating for component tolerances in the entire apparatus.

The high voltage analog signal through resistance 34 is applied to the reference amplifier 35, is passed through switch 47 to the center tap formed by the series connection of resistances 36 and 38. At this point, it will be observed that the resistances 36, 37, 38 and 39 form a series divider spanning the plus and minus E sources so that the bases of the transistors 40 and 41 may have their operating points properly set. The output of amplifier 35 will be seen to bring either transistor 40 or 41 into increased conduction depending upon the polarity of the signal from 35. Resistors 42 and 43 are conventional load or current-limiting resistors, the selection of which is a matter of ordinary design. The junction of these two resistors forms an output for the power amplifier comprising transistors 40 and 41 and their associated components. A suitable drive is thus available on 44, amplified in voltage and capable of providing a current drive for capacitor 13. The lead 44 itself comprises the reference amplifier feedback connection as will be seen, it being realized that this particular feedback regulated-subsystem tends to drive lead 44, such that the two inputs of reference amplifier 35 are brought into substantial equality before the next closure of 18. The resistors 34 and 48 are conventional, gain scaling resistors as frequently used in connection with operational amplifier circuitry.

It is not desired that this particular subsystem feedback loop be operative during the power pulse, i.e., when load switch 18 is closed. Accordingly, electronic switch capability is to be understood to be incorporated in 18 to operate the switch 47 such that it is open during and slightly before the on-time of 18 and otherwise closed. This avoids any tendency of the aforementioned reference and power amplifier circuits to control the voltage of the bootstrap capacitor 13 during that time.

It is also important to note that the current transformer 27 is emplaced above (i.e., adjacent to capacitor 12) the low voltage terminal with respect to the center point between capacitors 12 and 13. This expedient avoids the measuring of currents supplied at lead 44 to bring the capacitor 13 to the proper bootstrap voltage during the regulation part of the cycle, which, as forementioned, is within the immediate period of the pulse repetition period of this system preceding each transmitted pulse (closure of 18).

The scale factor of the integrator comprising 30, 31, and 32 (i.e., the quotient of voltage at 33 divided by ampere-seconds at 29) will be seen to be adjustable at 46 but is not to be considered critical. The measured control waveform at 44 might be differently selected in accordance with the requirements of a particular application, and adjustment of this integrator scale factor can be made in the aforementioned way for that purpose.

A radar system trigger signal input (not shown) would be supplied to 18 in the well understood manner in this art.

Variations and modifications in the arrangement of the figure and the specific circuits thereof will suggest themselves to those skilled in this art once the principles of the present invention are understood. Accordingly, it is not intended that the drawing in this description should be considered as limiting the scope of the invention, the drawing in this description being intended to be typical and illustrative only.

What is claimed is:

1. A direct current high voltage power supply regulation system particularly adapted for pulsed load applications comprising:

a source of incompletely regulated high voltage feeding a load through a pulsing control switch;

a first capacitor having a first terminal connected to said source of high voltage;

a second capacitor having a first terminal connected to the second terminal of said first capacitor, the second terminal of said second capacitor being connected to the return terminal of said source;

first means responsive to an electrical current flowing in the connection between said first and second capacitors to develop a first signal as a function of said current and which is the analog of said high voltage at said first capacitor first terminal;

and second means for developing a bootstrap voltage as a function of said first signal and for applying said bootstrap voltage across said second capacitor, the algebraic sum of the voltage across said first and second capacitors being said high voltage in regulated form.

2. Apparatus according to claim 1 in which said second capacitor is substantially larger in capacitance value as compared to said first capacitor, a much smaller fraction of said high voltage appearing across said second capacitor as compared to said first capacitor, whereby said first, second and third means may operate at low potentials isolated from said high voltage.

3. A direct current high voltage power supply regulating circuit operating from an inadequately regulated source of high voltage dc, comprising:

first and second capacitors in series connected as a unit in parallel with said source of high voltage, said unit acting as a filter capacitor and also as a capacitive voltage algebraic summer having a center tap at the connection between said capacitors;

first means for sensing the current flowing in said capacitors to generate a first signal as a function of said current;

second means for time integrating said first signal to provide a second signal which is the analog of said high voltage extant across said series capacitors as a unit;

and third means for applying said second signal in current amplified form and in appropriate sense to said center tap to control the voltage across said second capacitor, and by bootstrap action to thereby modify said high voltage to effect said regulation.

4. Apparatus according to claim 3 in which said first means comprises a current transformer connected in the current path between said capacitors at said center tap, said current transformer having an output providing said first signal.

5. Apparatus according to claim 4 in which said first means is located on the side of said center tap adjacent to said first capacitor, current from said third means into said second capacitor thereby not passing through said current transformer of said first means.

6. Apparatus according to claim 5 in which said second capacitor is substantially larger in capacitance value as compared to said first capacitor, a much smaller fraction of said high voltage appearing across said second capacitor as compared to said first capacitor, whereby said first, second and third means may operate at low potentials isolated from said high voltage.

7. Apparatus according to claim 4 in which said third means also includes a differential amplifier responsive to said second signal and to a reference potential derived from said center tap, said differential amplifier providing a current control signal of either polarity for controlling the voltage across said second capacitor, said current control signal being provided to said third means current amplifier, said current amplifier being capable of supplying currents to said second capacitor of either polarity.

8. Apparatus according to claim 3 in which said second means comprises an electronic integrator responsive to said first signal, said integrator including an input resistor, an amplifier and a feedback capacitor connected from output to input of said amplifier, and in which said second capacitor has one terminal connected to ground, said ground also being one terminal of said source.

9. Apparatus according to claim 8 in which said power supply is connected to a pulsed load, said pulsed load drawing power therefrom for a relatively short time, each pulse cycle being of short duration compared to the interval between pulses and in which electronically operated switch means are included for periodically grounding the input and output of said integrator amplifier and for short circuiting said integrator feedback capacitor at predetermined times between said load pulses to re-reference the operation of said bootstrapping.

* * * * *